US008113909B2

(12) United States Patent
Liu

(10) Patent No.: US 8,113,909 B2
(45) Date of Patent: Feb. 14, 2012

(54) CUSHIONING STRUCTURE FOR AN UNDERWIRE OF A BRASSIERE OR THE LIKE

(75) Inventor: Zhen Qiang Liu, Kwai Chung (HK)

(73) Assignee: Regina Miracle International Limited, Hong Kong (HK)

( * ) Notice: Subject to any disclaimer, the term of this patent is extended or adjusted under 35 U.S.C. 154(b) by 330 days.

(21) Appl. No.: 12/485,146

(22) Filed: Jun. 16, 2009

(65) Prior Publication Data

US 2010/0317258 A1 Dec. 16, 2010

(51) Int. Cl.
*A41C 3/00* (2006.01)

(52) U.S. Cl. ..... 450/41; 450/49; 450/51; 450/52

(58) Field of Classification Search ..... 450/41, 450/45, 47–49, 51, 52, 53, 54–58, 38, 39, 450/60–62; 2/255, 256, 258–261, 263
See application file for complete search history.

(56) References Cited

U.S. PATENT DOCUMENTS 3,114,374 A * 12/1963 Chalfin et al. ..... 450/41
3,190,232 A * 6/1965 Budzich ..... 417/222.1
3,209,756 A * 10/1965 Rowell ..... 450/52
3,605,753 A * 9/1971 Schwartz ..... 450/52
6,682,395 B2 * 1/2004 Falla et al. ..... 450/41
6,857,934 B2 * 2/2005 Chan ..... 450/41
6,896,580 B2 * 5/2005 Falla et al. ..... 450/41
7,207,861 B2 * 4/2007 Martini ..... 450/49

* cited by examiner

*Primary Examiner* — Gloria Hale

(74) *Attorney, Agent, or Firm* — Ostrolenk Faber LLP

(57) ABSTRACT

There is provided an improved brassiere comprising a pair of breast cups; a connector securing together an inner edge of each of the breast cups; a back wing or pair of back wings for securing the brassiere to the torso of a wearer; and an underwire disposed about a lower periphery of each breast cup. A cushioning structure for the underwire comprises an inner sleeve for receiving the underwire, the inner sleeve having two major surfaces and opposed elongate edges; a cushioning material covering at least one of the major surfaces; and a panel of outer fabric having first and second opposed elongate edges; wherein the first and second elongate edges of the panel of outer fabric each fold over an opposed elongate edge of the inner sleeve to substantially cover the cushioning material. A cushioning structure and a method of making the same are also provided.

20 Claims, 2 Drawing Sheets

CUSHIONING STRUCTURE FOR AN UNDERWIRE OF A BRASSIERE OR THE LIKE

FIELD OF THE INVENTION

The present invention relates generally to brassieres or the like. More particularly, the present invention relates to a cushioned underwire for use in a brassiere or similar undergarments including swimwear. A method for making a cushioning structure for an underwire is also provided.

BACKGROUND OF THE INVENTION

A conventional brassiere comprises of a pair of breast cups intended to cover and support the breasts of the wearer, a connector securing together the inner edges of the cups at the wearer's cleavage, and at least one strap-like back or wing that extends from outer edges of the breast cups around the back of the wearer. The brassiere may further include shoulder straps that extend from upper edges of the breast cups over the shoulders of the wearer to attachment points on the strap-like back or wing crossing the wearer's back.

It is common for a brassiere or similar undergarments to use an underwire to shape and support the lower periphery of each breast cup. An underwire typically consists of a U-shaped frame formed from metal or a rigid plastic material. Usually a pair of underwires is incorporated into a brassiere or other undergarment to provide shape and support for a pair of breast cups. However, in some forms the underwire may comprise a single underwire frame which traverses both breast cups.

Underwires are typically inserted into fabric sleeves positioned about the lower periphery of each breast cup. It is important that the underwires exhibit sufficient stiffness to provide the desired support and shaping functions, but do not poke through the fabric sleeve causing discomfort and possibly damaging the wearer's skin or clothing.

It would be desirable to provide an improved cushioning structure for an underwire which provides enhanced comfort to a wearer.

Other objects and advantages of the invention will become apparent to those of ordinary skill in the art having reference to the following specification together with its drawings.

SUMMARY OF THE INVENTION

According to an aspect of the present invention, there is provided a cushioning structure for an underwire of a brassiere or the like comprising:

an inner sleeve for receiving the underwire, the inner sleeve having two major surfaces and opposed elongate edges;

a cushioning material covering at least one of the major surfaces; and a panel of outer fabric having first and second opposed elongate edges;

wherein the first and second elongate edges of the panel of outer fabric each folds over an opposed elongate edge of the inner sleeve to substantially cover the cushioning material.

In a preferred form, the second elongate edge of the panel of outer fabric overlaps the first elongate edge of the panel of outer fabric.

More preferably, a casing formed by the panel of outer fabric is sealed by bonding an inwardly facing region proximal to the second elongate edge of the panel of outer fabric to an outwardly facing region proximal to the first elongate edge of the panel of outer fabric.

The casing may be bonded to the inner sleeve such that an inwardly facing region proximal to the first elongate edge of the panel of outer fabric is bonded to a major surface of the inner sleeve.

In a particular embodiment, the cushioning material is bonded to at least one of the major surfaces of the inner sleeve. The bonding is preferably by lamination, or by means selected from one or more of an adhesive or one or more stitches.

The cushioning material may be elected from one or more of foam, fibre fill, silicon gel, or a bladder filled with air or fluid.

According to another aspect of the present invention, there is provided an improved brassiere comprising:

a pair of breast cups;

a connector securing together an inner edge of each of the breast cups;

a back wing or pair of back wings for securing the brassiere to the torso of a wearer;

an underwire disposed about a lower periphery of each breast cup;

a cushioning structure for the underwire comprising:

an inner sleeve for receiving the underwire, the inner sleeve having two major surfaces and opposed elongate edges;

a cushioning material covering at least one of the major surfaces; and a panel of outer fabric having first and second opposed elongate edges;

wherein the first and second elongate edges of the panel of outer fabric each folds over an opposed elongate edge of the inner sleeve to substantially cover the cushioning material.

In a preferred form, the second elongate edge of the panel of outer fabric overlaps the first elongate edge of the panel of outer fabric.

More preferably, a casing formed by the panel of outer fabric is sealed by bonding an inwardly facing region proximal to the second elongate edge of the panel of outer fabric to an outwardly facing region proximal to the first elongate edge of the panel of outer fabric.

In one embodiment, an inwardly facing region proximal to the first elongate edge of the panel of outer fabric is bonded to a major surface of the inner sleeve.

In one particular form, the cushioning material is bonded to at least one of the major surfaces of the inner sleeve. The bonding is preferably by lamination, or by means selected from one or more of an adhesive or one or more stitches.

The cushioning material may be selected from one or more of foam, fibre fill, silicon gel, or a bladder filled with air or fluid.

According to yet another aspect of the present invention, there is provided a method of making a cushioning structure for an underwire of a brassiere or the like, the method comprising the following steps:

providing an inner sleeve for receiving the underwire, the inner sleeve having two major surfaces and opposed elongate edges;

covering at least one major surface of the inner sleeve with a cushioning material;

bonding a panel of outer fabric to the inner sleeve with the cushioning material secured thereto, the panel of outer fabric having first and second opposed elongate edges which extend beyond the opposed elongate edges of the inner sleeve;

folding the first and second opposed elongate edges of the panel of outer fabric which extend beyond the elongate edges of the inner sleeve with the cushioning material secured thereto to substantially cover the cushioning material; and trimming the cushioning structure to fit an underwire.

Preferably, the second elongate edge of the panel of outer fabric is folded so as to overlap the first elongate edge of the panel of outer fabric.

More preferably, the method further comprises the step of bonding an inwardly facing region proximal to the second elongate edge of the panel of outer fabric to an outwardly facing region proximal to the first elongate edge of the panel of outer fabric.

Even more preferably, the method further comprises the step of bonding an inwardly facing region proximal to the first elongate edge of the panel of outer fabric to a major surface of the inner sleeve.

The bonding may occur by means selected from one or more of an adhesive or one or more stitches.

BRIEF DESCRIPTION OF THE DRAWINGS

It will be convenient to hereinafter describe the invention in greater detail by reference to the accompanying figures which facilitate understanding of the method according to this invention. The particularity of the figures and the related description is not to be understood as superseding the generality of the broad identification of the invention as given in the attached claims.

DETAILED DESCRIPTION

Figure 1:
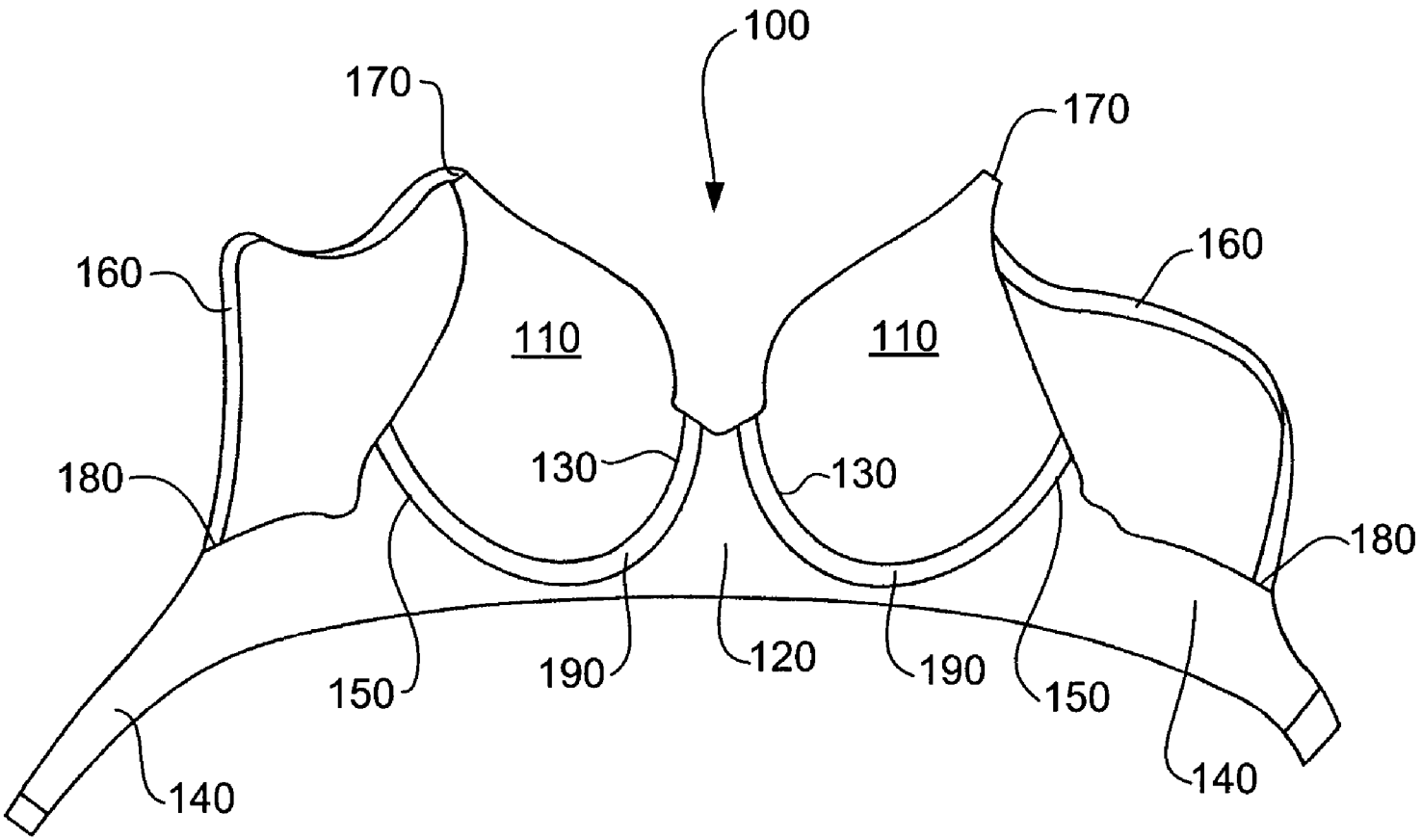
FIG. 1 is a schematic drawing of a brassiere incorporating the cushioning structure for an underwire embodying the principles of the present invention.

Referring firstly to FIG. 1, there is shown a typical brassiere 100 comprising of a pair of breast cups 110 intended to cover and support the breasts of the wearer, a connector 120 securing together the inner edges of the cups 130 at the wearer's cleavage, and at least one strap-like back or wing 140 that extends from the outer edges 150 of the breast cups around the back of the wearer. The brassiere 100 may further include shoulder straps 160 that extend from upper edges 170 of the breast cups 110 over the shoulders of the wearer to attachment points 180 on the back wing or wings 140 crossing the wearer's back.

The brassiere 100 further includes a pair of substantially U-shaped under wires to shape and support the lower periphery of each breast cup 110. An underwire (see FIG. 2A) typically consists of a U-shaped frame formed from metal or a rigid plastic material. In this case the brassiere includes a pair of underwires positioned about the lower periphery 190 of each breast cup 110.

Referring now to FIGS. 2A to 2D, the present invention provides an improved cushioning structure 200 for brassiere underwires 210 intended to enhance wearer comfort and to help prevent damage to the wearer's skin or clothing.

Figure 2B:
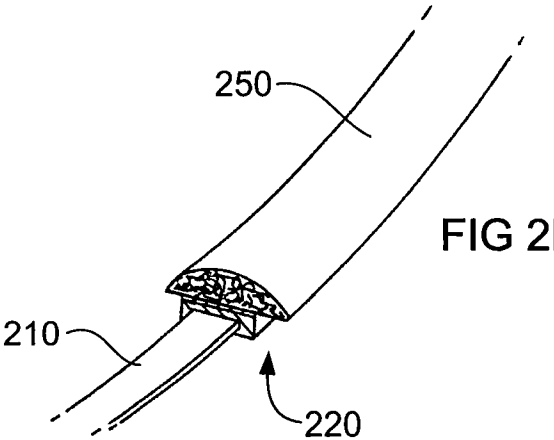
FIG. 2B is a perspective view of the inner sleeve of FIG. 2B with cushioning material secured thereto.
Figure 2D:
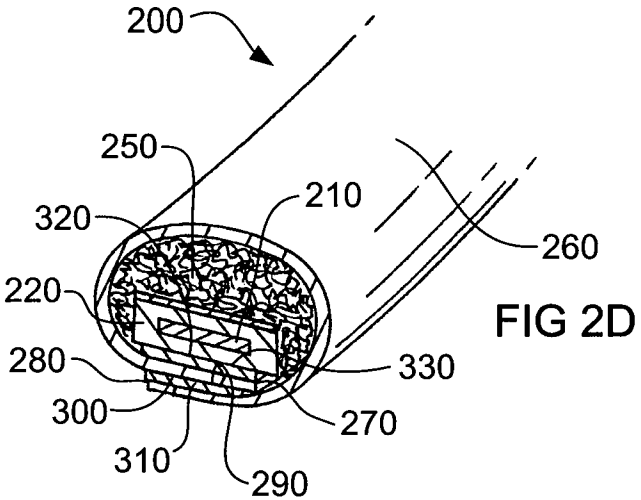
FIG. 2D is a perspective view of the inner sleeve and cushioning material structure covered in part by a panel of outer material of FIG. 2C finished off to form a cushioning structure for receiving an underwire.
Figure 2A:
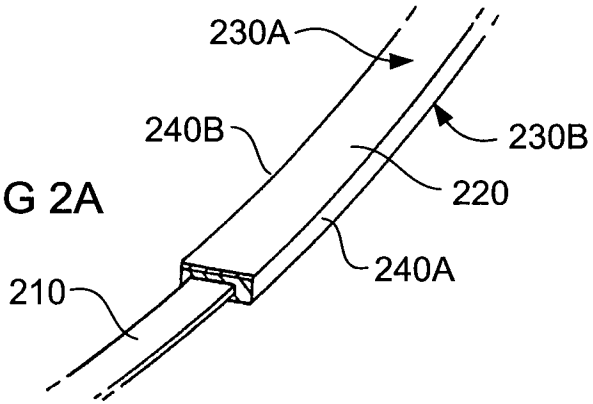
FIG. 2A is a perspective view showing an inner sleeve for receiving an underwire.

Referring firstly to FIG. 2A, there is shown an underwire 210 inserted into an inner sleeve 220. The inner sleeve 220 has two major surfaces 230A and 230B and two opposed elongate edges 240A and 240B. The inner sleeve 220 may be formed of fabric and could be, for example a conventional fabric sleeve used to encase an underwire.

Referring now to FIG. 2B, a cushioning material 250 covers at least one of the major surfaces 230A, 230B of the inner sleeve 220. Preferably, the cushioning material 250 is bonded to at least one of the major surfaces 230A, 230B, for example by laminating.

Figure 2C:
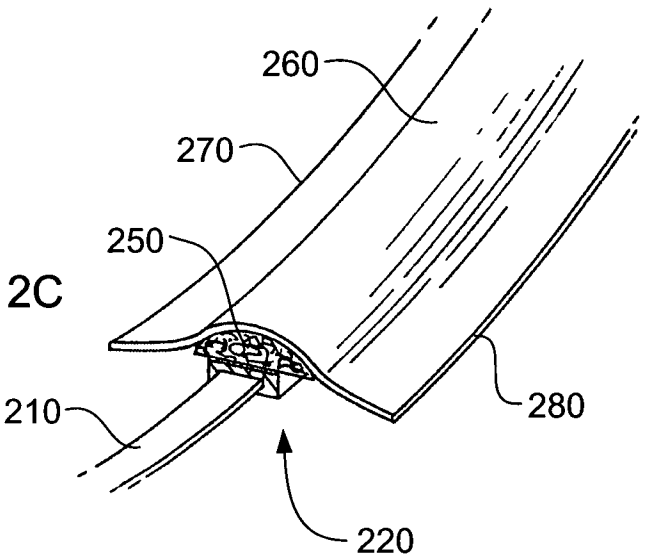
FIG. 2C is a perspective view of the inner sleeve and cushioning material structure of FIG. 2B covered in part by a panel of outer material.

Referring now to FIG. 2C, a panel of outer fabric 260 covers the cushioning material 250. the panel of outer fabric has two opposed elongate edges running along the length of the fabric, i.e. a first elongate edge 270 and a second elongate edge 280.

Referring now to FIG. 2D, the first elongate edge 270 and second elongate edge 280 of the panel of outer fabric 260 each folds over an opposed elongate edge 240A, 240B of the inner sleeve 220 to substantially cover the cushioning material 250. In the illustrated embodiment, the second elongate edge 280 of the panel of outer fabric 260 overlaps the first elongate edge 270 of the panel of outer fabric.

The casing formed by the panel of outer fabric 260 is preferably sealed by bonding an inwardly facing region 290 proximal to the second elongate edge 280 of the panel of outer fabric 260 to an outwardly facing region 300 proximal to the first elongate edge 270 of the panel of outer fabric. The bonding may be achieved by the application of a suitable adhesive 310. Moreover, it is preferred that an inwardly facing region 320 proximal to the first elongate edge 270 of the panel of outer fabric 260 is bonded to a major surface 230B of the inner sleeve 220 using an adhesive 330.

The panel of outer fabric preferably consists of the same or similar fabric exhibiting at least some elasticity which is used to form a substantial portion of the brassiere. The cushioning material is selected from any suitable resilient material providing the desired cushioning properties such as foam, fibre fill, silicon gel, or a bladder filled with air or fluid.

The improved cushioning structure 200 described with reference to FIGS. 2A to 2D is readily incorporated into a brassiere 100 by trimming the cushioning structure to size and securing the cushioning structure about the lower periphery 190 of each breast cup 110. The cushioning structure 200 may be secured to the lower periphery 190 of each breast cup 110 by any suitable means such as stitching. Generally at least one end of the cushioning structure 200 will remain open until such time that an underwire 210 has been received therein. After such time, the open end of the cushioning structure 200 is closed, i.e. by stitching to secure the underwire 210 within the cushioning structure.

The cushioning structure 200 of the present invention may be manufactured by firstly transferring an adhesive to the inner sleeve 220 using a release paper. The inner sleeve with the adhesive applied is then subjected to a heat moulding process together with a panel of cushioning material. This process laminates the inner sleeve 220 to the cushioning material 250 and at the same time moulds the cushioning material to the desired shape. This results in the precursor cushioning structure shown in FIG. 2B.

Adhesive is also applied to the panel of outer fabric 260 using a release paper. This outer panel of fabric 260 is laminated with the inner sleeve 220 and cushioning material 250 assembly shown in FIG. 2B, to form the assembly shown in FIG. 2C.

Adhesive is then applied to the first and second opposed elongate edges 270 and 280 of the panel of outer fabric 260 using two strips of release paper. The cushioning structure 200 is fully formed by successive folding of the first and second opposed elongate edges 270 and 280 of the panel of outer fabric 260 which extend beyond the elongate edges 240A and 240B of the inner sleeve 220 with the cushioning material 250 secured thereto. The second elongate edge 280 of the panel of outer fabric 260 is preferably folded so as to overlap the first elongate edge 270 of the panel of outer fabric as shown in FIG. 2D.

Use of the adhesive on the first and second opposed elongate edges 270 and 280 of the panel of outer fabric 260 ensures that an inwardly facing region 290 proximal to the second elongate edge 280 of the panel of outer fabric 260 is bonded to an outwardly facing region 300 proximal to the first elongate edge 270 of the panel of outer fabric 260. The inwardly facing region 320 proximal to the first elongate edge 270 of the panel of outer fabric 260 is bonded to a major surface 230B of the inner sleeve 220.

Preferably, the adhesive referred to herein is a hot melt adhesive, however, it will be understood that various other suitable types of suitable adhesives are available which could be used to form the cushioning structure of the present invention. Moreover, alternative bonding methods including mechanical means such as sewing or stapling may be used to achieve a similar result.

It is an advantage of the present invention that the cushioning structure reduces the discomfort associated with wearing an underwire brassiere and ameliorates the problems of damaging clothes and/or skin or a wearer. The cushioning structure serves as a buffer between the underwire and the wearer's skin.

While the invention has been described in conjunction with a limited number of embodiments, it will be appreciated by those skilled in the art that many alternative, modifications and variations in light of the foregoing description are possible. Accordingly, the present invention is intended to embrace all such alternative, modifications and variations as may fall within the spirit and scope of the invention as disclosed.

The invention claimed is:

1. A cushioning structure for an underwire of a brassiere comprising:

an inner sleeve containing the underwire, the inner sleeve having two major outside surfaces and opposed elongate edges;

a cushioning material covering at least one of the two major outside surfaces; and a panel of outer fabric having first and second opposed elongate edges;

wherein the first and second elongate edges of the panel of outer fabric is each folded over one said opposed elongate edge of the inner sleeve containing the underwire to substantially cover the cushioning material.

2. The cushioning structure for an underwire of a brassiere according to claim 1, wherein the second elongate edge of the panel of outer fabric overlaps the first elongate edge of the panel of outer fabric to form a casing.

3. The cushioning structure for an underwire of a brassiere according to claim 2, wherein a casing formed by the panel of outer fabric is sealed by bonding an inwardly facing region proximal to the second elongate edge of the panel of outer fabric to an outwardly facing region proximal to the first elongate edge of the panel of outer fabric.

4. The cushioning structure for an underwire of a brassiere according to claim 3, wherein the casing is bonded to the inner sleeve.

5. The cushioning structure for an underwire of a brassiere according to claim 3, wherein an inwardly facing region proximal to the first elongate edge of the panel of outer fabric is bonded to a major surface of the inner sleeve.

6. The cushioning structure for an underwire of a brassiere according to claim 1, wherein the cushioning material is bonded to at least one of the major surfaces of the inner sleeve.

7. The cushioning structure for an underwire of a brassiere according to claim 1, wherein the cushioning material is bonded to at least one of the major surfaces of the inner sleeve by lamination.

8. The cushioning structure for an underwire of a brassiere according to claim 1, wherein the cushioning material is selected from one or more of foam, fiber fill, silicon gel, or a bladder filled with air or fluid.

9. A brassiere comprising:

a pair of breast cups;

a connector securing together an inner edge of each of the breast cups;

a back wing or pair of back wings for securing the brassiere to the torso of a wearer;

an underwire disposed about a lower periphery of each breast cup;

a cushioning structure for the underwire comprising:

an inner sleeve for receiving the underwire, the inner sleeve having two major surfaces and opposed elongate edges;

a cushioning material covering at least one of the major surfaces; and a panel of outer fabric having first and second opposed elongate edges;

wherein the first and second elongate edges of the panel of outer fabric each folds over an opposed elongate edge of the inner sleeve to substantially cover the cushioning material.

10. The brassiere according to claim 9, wherein the second elongate edge of the panel of outer fabric overlaps the first elongate edge of the panel of outer fabric to form a casing.

11. The brassiere according to claim 10, wherein a casing formed by the panel of outer fabric is sealed by bonding an inwardly facing region proximal to the second elongate edge of the panel of outer fabric to an outwardly facing region proximal to the first elongate edge of the panel of outer fabric.

12. The brassiere according to claim 9, wherein an inwardly facing region proximal to the first elongate edge of the panel of outer fabric is bonded to a major surface of the inner sleeve.

13. The brassiere according to claim 9, wherein the cushioning material is bonded to at least one of the major surfaces of the inner sleeve.

14. The brassiere according to claim 9, wherein the cushioning material is bonded to at least one of the major surfaces of the inner sleeve by lamination.

15. The brassiere according to claim 9, wherein the cushioning material is selected from one or more of foam, fiber fill, silicon gel, or a bladder filled with air or fluid.

16. A method of making a cushioning structure for an underwire of a brassiere, the method comprising the following steps:

providing an inner sleeve containing the underwire, the inner sleeve having two major outside surfaces and opposed elongate edges;

covering at least one said major outside surface of the inner sleeve with a cushioning material;

bonding a panel of outer fabric to the inner sleeve with the cushioning material secured thereto, the panel of outer fabric having first and second opposed elongate edges which extend beyond the opposed elongate edges of the inner sleeve;

folding the first and second opposed elongate edges of the panel of outer fabric which extend beyond the elongate edges of the inner sleeve with the cushioning material secured thereto to substantially cover the cushioning material; and trimming the cushioning structure to fit an underwire.

17. A method of making a cushioning structure for an underwire of a brassiere according to claim 16, wherein the second elongate edge of the panel of outer fabric is folded so as to overlap the first elongate edge of the panel of outer fabric.

18. A method of making a cushioning structure for an underwire of a brassiere according to claim 16, further comprising the step of bonding an inwardly facing region proximal to the second elongate edge of the panel of outer fabric to an outwardly facing region proximal to the first elongate edge of the panel of outer fabric.

19. A method of making a cushioning structure for an underwire of a brassiere according to claim 16, further comprising the step of bonding an inwardly facing region proximal to the first elongate edge of the panel of outer fabric to a major surface of the inner sleeve.

20. A method of making a cushioning structure for an underwire of a brassiere according to claim 16, wherein the bonding occurs by means selected from one or more of an adhesive or one or more stitches.

* * * * *